US006877836B2

(12) United States Patent
Wu

(10) Patent No.: US 6,877,836 B2
(45) Date of Patent: Apr. 12, 2005

(54) SERVICE STATION

(75) Inventor: Chiung-Lun Wu, Kaohsiung (TW)

(73) Assignee: International United Technology Co., Ltd., Hsin-Chu (TW)

( * ) Notice: Subject to any disclaimer, the term of this patent is extended or adjusted under 35 U.S.C. 154(b) by 0 days.

(21) Appl. No.: 10/604,171

(22) Filed: Jun. 30, 2003

(65) Prior Publication Data

US 2004/0174410 A1 Sep. 9, 2004

(30) Foreign Application Priority Data

Mar. 7, 2003 (TW) ..... 92104890 A

(51) Int. Cl.[7] ..... B41J 2/165
(52) U.S. Cl. ..... 347/33; 347/29
(58) Field of Search ..... 347/22, 29, 32, 347/33, 30

(56) References Cited

U.S. PATENT DOCUMENTS 5,663,751 A * 9/1997 Holbrook ..... 347/22

FOREIGN PATENT DOCUMENTS

JP 408207293 A * 8/1996

* cited by examiner

*Primary Examiner*—Shih-Wen Hsieh
(74) *Attorney, Agent, or Firm*—Jiang Chyun IP Office

(57) ABSTRACT

A service station for cleaning and sealing the print head of a print module in a printing system is provided. The service station comprises a base, a first direction-changing mechanism, a first moving mechanism and a wiper. The print module drives the first direction-changing mechanism, which drives the first moving mechanism and hence the wiper to clean up the print head. Furthermore, the service station comprises a second direction-changing mechanism, a second moving mechanism and a cap. The print module drives the second direction-changing mechanism, which drives the second moving mechanism and hence the cap to seal the print head.

16 Claims, 2 Drawing Sheets

SERVICE STATION

CROSS REFERENCE TO RELATED APPLICATIONS

This application claims the priority benefit of Taiwan application serial no. 92104890, filed on Mar. 07, 2003.

BACKGROUND OF INVENTION

1. Field of Invention

The present invention relates to a service station. More particularly, the present invention relates to the service station that cleans and seals the print head of a print module in a printing system (an inject printer) and converts the movement of the print module into driving force.

2. Description of Related Art

Following the rapid development of home computers and related peripheral products, different types of computer peripheral products have been developed to meet the demands of various users. The two major electronic products for outputting computer data are displays and printers. Many types of printers are currently available including, for example, laser printers, inkjet printers and thermal printers. Since inkjet printers are smaller and cheaper relative to the other types of printers, they have become one of the most popular printers.

The inkjet printing technique relies on applying a momentary pressure to the ink inside an ink reservoir or heating the ink to produce a thermal bubble in pressure so that ink is ejected from the ink nozzle. The ejected ink forms spherical droplets that attach to the surface of a print document. Hence, by controlling the action of each ink nozzle through controlling the inkjet chip as well as the horizontal movement of the print head and the vertical movement of the print document, ink droplets are guided to fall on the desired print surface location, thereby forming a sheet of text or graph.

In general, the colorful dots on the page of a printed document are defined by mixing three complementary dyestuffs including cyan, magenta and yellow (CMY) together in suitable proportions. Since mixing cyan, magenta and yellow dyestuffs together cannot produce the color black, most color printers have an independent chip for processing black color. In other words, a color printer must incorporate a color subtraction module with color dyes including cyan, magenta, yellow and black.

In general, most inkjet printing systems also incorporate a service station for cleaning and sealing the nozzles on the print head of a print module after each printing job. The service station normally includes a wiper. Some service station may additionally include a sealing cap. The wiper is used once in a while to remove the accumulated ink (residual ink) and dirt from the area around the ink nozzles of the print head. The sealing cap seals off the nozzles when the print head is not in use so that the ink within the nozzles is prevented from drying up and hence blocking the nozzles.

FIG. 1 is a perspective view of a motor-driven wiper and a sealing cap for a conventional service station. As shown in FIG. 1, the service station 100 comprises a housing 102, a wiper 104, a cap 106, a base 108 and a stepping motor 110. The base 108 is formed inside the housing 102 and driven by the stepping motor 110 and a driving mechanism (not shown) to move linearly along the Y-axis of the housing 102. Furthermore, both the wiper 104 and the cap 106 are also simultaneously driven by the base 108 to move linearly along the Y-axis of the housing 102. After a printing job, the print head (not shown) of the print module will return to a position above the housing 102 of the service station 100 so that the nozzles (not shown) on the print head are positioned on the linear swiping pathway of the wiper 104. Therefore, the motor 110 driving the base 108 also moves the wiper 104 linearly to scrape off any residual ink on the nozzles of the print head. In similar way, the motor 110 also raises the base 108 up through a driving mechanism such that the print head is tightly covered by the cap 106 to prevent the ink from drying.

The conventional service station uses the rotary action of a stepping motor and the linear motion of the print module which is to print ink on plain paper or the like to clean the nozzles and seal the print head. However, it is simpler and costs less to drive the service station using the linear motion of the print module because no electric motor and associated control circuits required in the present invention.

SUMMARY OF INVENTION

Accordingly, one object of the present invention is to provide a service station of an inkjet print head driven by the linear motion of a print module so that the cost of the service station can be reduced.

To achieve these and other advantages and in accordance with the purpose of the invention, as embodied and broadly described herein, the invention provides a service station for cleaning and sealing the print head of a print module in a printing system. The service station comprises a base, a first direction-changing mechanism, a first moving mechanism, at least a wiper, a second direction-changing mechanism, a second moving mechanism and at least a cap. The first direction-changing mechanism is set up on the base. The first moving mechanism is also set up on the base and coupled to the first direction-changing mechanism. The wiper is set up on the first moving mechanism. The print module drives the first direction-changing mechanism and hence moves the wiper attached to the first moving mechanism across the nozzles on the print head and clears away any dry ink on the nozzles. In addition, the second direction-changing mechanism is set up on the base. The second moving mechanism is also set up on the base and coupled to the second direction-changing mechanism. The cap is set up on the second moving mechanism. The print module drives the second direction-changing mechanism and hence moves the cap attached to the second moving mechanism to seal off the print head.

According to the embodiment of this invention, the first direction-changing mechanism in the service station furthermore comprises a gear, a rod and a bumper plate. The gear is connected onto the base. One end of the rod is connected to the gear while the other end of the rod is connected to the bumper plate. The bumper plate is located at a position on the traveling pathway of the print head and can be driven by the print module. When the bumper plate rotates, the rod also rotates and hence turns the gear as well.

According to the embodiment of this invention, the base in the service station also has a groove. The first moving mechanism furthermore comprises a wiping base, a sliding track and a gear rack. The wiper is set up on the wiping base. The sliding track and the gear rack are set up below the wiping base. The sliding track is flush onto the groove in the base. The gear rack is coupled to the gear in the first direction-changing mechanism. Furthermore, the wiping base will move when the gear rack is driven by the gear.

According to the embodiment of this invention, the angle between direction of movement of the print module and the direction of movement of the wiper is greater than 70° or equal to about 70°.

According to the embodiment of this invention, the second direction-changing mechanism in the service station furthermore comprises a gear, a rod and a bumper plate. The gear is connected onto the base. One end of the rod is connected to the gear while the other end of the rod is connected to the bumper plate. The bumper plate is located at a position on the traveling pathway of the print head and can be driven by the print module. When the bumper plate rotates, the rod also rotates and hence turns the gear as well.

According to the embodiment of this invention, the base in the service station also has another groove. The second moving mechanism furthermore comprises a capping base, a sliding track and a gear rack. The cap is set up on the capping base. The sliding track and the gear rack are set up on the side of the capping base. The sliding track is flush onto the groove in the base. The gear rack is coupled to the gear in the second direction-changing mechanism. Furthermore, the capping base will move when the gear rack is driven by the gear.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION

Figure 1:
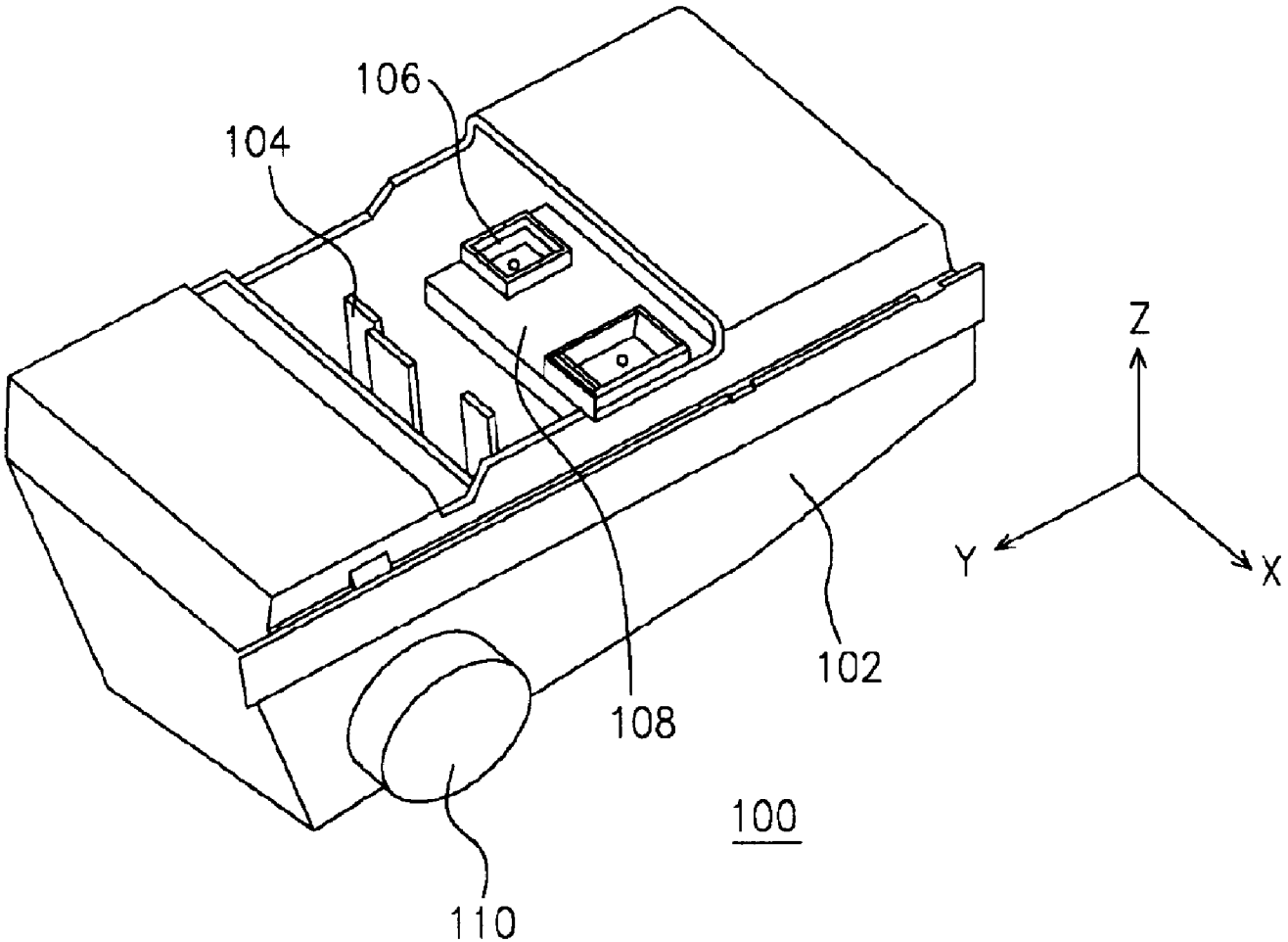
FIG. 1 (PRIOR ART)
FIG. 1 is a perspective view of a motor-driven wiper and caps on a conventional service station.

Reference will now be made in detail to the present preferred embodiments of the invention, examples of which are illustrated in the accompanying drawings. Wherever possible, the same reference numbers are used in the drawings and the description to refer to the same or like parts.

Figure 2:
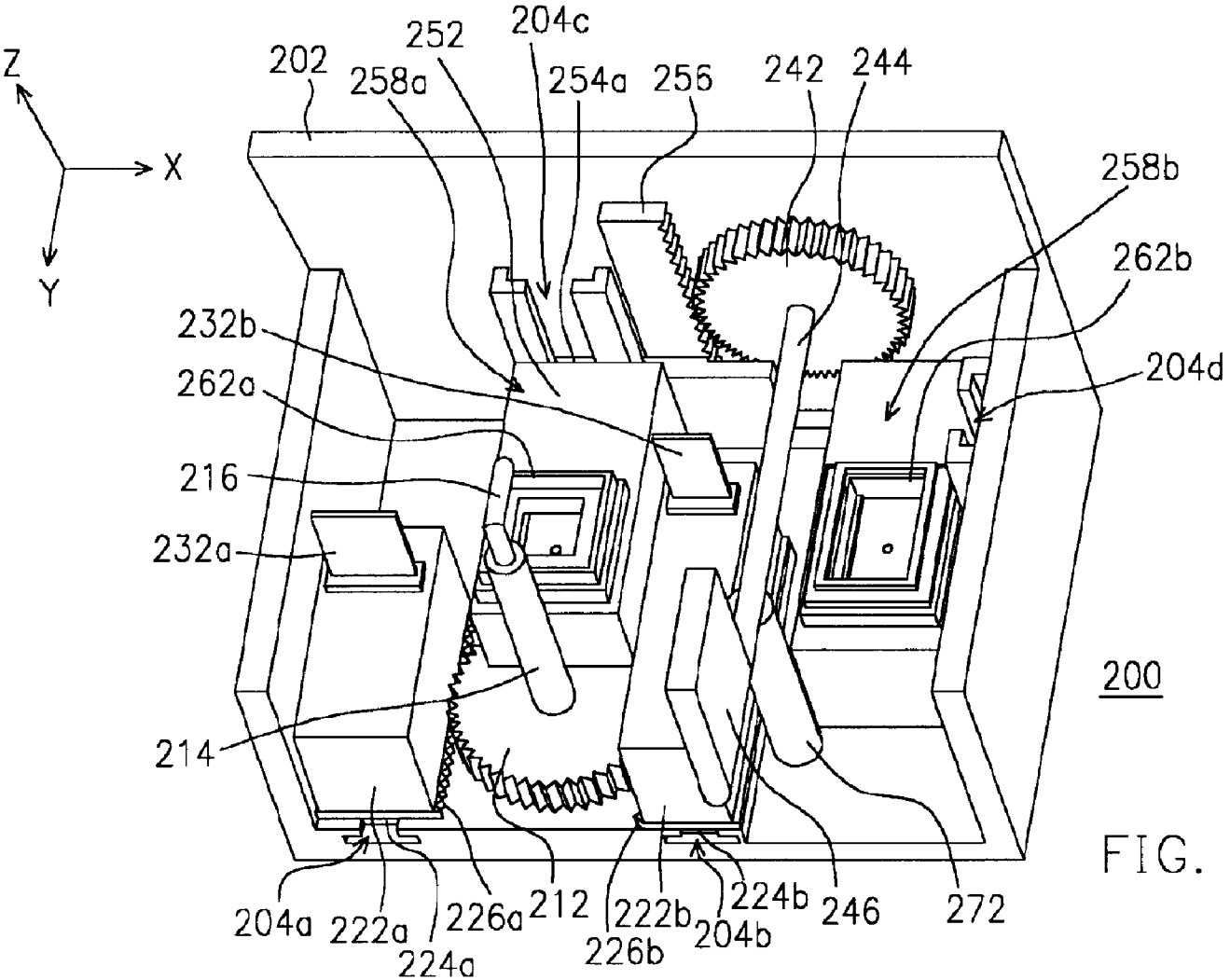
FIG. 2 is a perspective view showing all the major components inside a service station according to one preferred embodiment of this invention.

FIG. 2 is a perspective view showing all the major components inside a service station according to one preferred embodiment of this invention. As shown in FIG. 2, the service station 200 comprises a base 202, a first direction-changing mechanism, a first moving mechanism, a first wiper 232*a* and a second wiper 232*b*, a second direction-changing mechanism, a second moving mechanism, a first cap 262*a* and a second cap 262*b*. The base 202 has a plurality of grooves 204*a*, 204*b*, 204*c* and 204*d*. The first direction-changing mechanism comprises a gear 212, a rod 214 and a bumper plate 216. The gear 212 is connected onto the base 202. One end of the rod 214 is connected to the gear 212 in an axial position while the other end of the rod 214 is attached to the bumper plate 216. A print module (not shown) moves in an X-direction as shown in FIG. 2. The bumper plate 216 is located on the traveling path of the print module. The print module will bump into the bumper plate 216 as it returns to the top of the service station 200 and turn the bumper plate 216 in a clockwise direction (top view). Through the action by the bumper plate 216, the rod 214 also drives the gear 212 into rotation.

As shown in FIG. 2, the first moving mechanism comprises a pair of wiping bases 222*a*, 222*b*, a pair of sliding tracks 224*a*, 224*b* and a pair of gear racks 226*a*, 226*b*. Both wiping bases 222*a*, 222*b* are set up on the base 202. Wipers 232*a*, 232*b* are attached to the respective wiping bases 222*a*, 222*b*. The two sliding tracks 224*a*, 224*b* are set up at the respective bottom section of the wiping bases 222*a*, 222*b*. The sliding tracks 224*a*, 224*b* are engaged with the respective grooves 204*a*, 204*b* on the base 202. The two gear racks 226*a*, 226*b* are set up on the side surface of the respective wiping bases 222*a*, 222*b*. The gear racks 226*a*, 226*b* mesh with gear 212 of the first direction-changing mechanism. When the gear 212 of the first direction-changing mechanism is indirectly driven by the print module into rotation, the gear 212 will drive one of the gear racks (226*a* or 226*b*) forward and the other gear rack backward. Hence, one of the wiping bases (222*a* or 222*b*) will move forward and the other wiping base will move backward in the Y-direction. Through the movement of the wiping bases 222*a* and 222*b*, the wipers 232*a* and 232*b* can scrap away residual ink on the print head of the print module.

In FIG. 2, the angle between the direction of movement of the print module (the X-direction) and the direction of movement of the wipers 232*a*, 232*b* is approximately equal to 90°. However, the angle can also be smaller than 90° so that the wipers 232*a*, 232*b* move at an angle relative to the print module so that the partial vector of the scraping direction (in the Y-direction) is relatively parallel to the direction of the arrangement of the nozzles of the print head. In other words, the wipers 232*a*, 232*b* are capable of scraping the ink on all of the nozzles.

Similarly, the second direction-changing mechanism comprises a gear 242, a rod 244 and a bumper plate 246. The gear 242 is connected to the base 202. One end of the rod 244 is connected to the gear 242 in an axial position and the other end of the rod 244 is connected to the bumper plate 246. A supporter 272 supports the rod 244 so that the rod 244 is prevented from tilting and bending. The bumper plate 246 of the second direction-changing mechanism is located on the traveling pathway of the print module. Hence, the print module will contact and then move the bumper plate 246 on the second direction-changing mechanism, after the print module has carried out the ink scraping action, so that the bumper plate 246 rotates clockwise along the X-Z plane. Therefore, the rod 244 linked to the bumper plate 246 rotates and drives the gear 242 into rotation.

The second moving mechanism comprises a capping base 252, a pair of sliding tracks 254*a*, 254*b* (not shown) and a gear rack 256. The capping bag 252 is set up on the bass 202. The capping base 252 has a pair of capping surfaces 258*a*, 258*b* each having a cap 262*a*, 262*b*. The two sliding tracks 254*a*, 254*b* (not shown) are set up on the respective side surface of the capping base 252 and engage with the grooves 204*c*, 204*d* respectively on the base 202. The gear rack 256 is attached to the side surface of the capping base 252 and coupled with the gear 242 of the second direction-changing mechanism. Thus, the gear 242 will drive the gear rack 256 and hence lift the capping base 252 upwards In the Z-direction when the gear 242 of the second direction-changing mechanism is Indirectly driven by the movement of the print module. Eventually, the caps 262*a*, 262*b* will cap the print head of the print module and maintain the nozzles at a high relative humidity. The print module is now In a stopping mode. Note that the caps 262*a*, 262*b* move along the direction of movement of the capping base 252 (the Z-axis). Therefore, the angle between the direction of movement of the cap 262*a* (or the cap 262*b*) and the direction of movement of the print module (the X-axis) is greater than or equal to 70°, and the preferred angle is approximately 90°.

In summary, the service station according to this station utilizes a direction-changing mechanism to convert the linear motion of the print module into rotary action. Thereafter, a moving mechanism is employed to convert the rotary action back to a linear action for driving the wipers and caps. In other words, the linear motion of the print module is used to drive the wipers for removing dried ink on the print head and the caps for sealing the print head of the print module. Since the service station is not powered by a stepping motor, overall production cost can be reduced because there is no need to install additional stepping motor and its associated control circuits.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A service station for a print head of a print module in a printing system, comprising:

a base;

a first direction-changing mechanism set up on the base;

a first moving mechanism set up on the base and coupled to the first direction-changing mechanism;

a wiper set up on the first moving mechanism, wherein the, print module drives the first direction-changing mechanism and, in turn, drives the first moving mechanism so that the wiper is set in motion and slides across the print head to clear away dried ink from the print head via a linear moving of the first moving mechanism a second direction-changing mechanism set up on the base;

a second moving mechanism set up on the base and coupled to the second direction-changing mechanism; and at least one cap set up on the second moving mechanism, wherein the print module drives the second direction-changing mechanism and, in turn, drives the second moving mechanism so that the capes is moved to a position that seals off the print head.

2. The service station of claim 1, wherein the first direction-changing mechanism furthermore comprises a gear, a rod and a bumper plate, the gear is connected to the base, one end of the rod connects with the gear, the other end of the rod connects with the bumper plate and the bumper plate is positioned on a traveling path of the print module so that a rotation of the gear caused by the rotation of the rod when the print module acts on the bumper plate drives the first moving mechanism.

3. The service station of claim 2, wherein the base furthermore comprises a groove and the first moving mechanism furthermore comprises a wiping base, a sliding track and a gear rack, the wiper is set up on the wiping base, the sliding track and the gear rack are also set up on the wiping base with the sliding trick engaged with the groove on the base, and the gear rack and the gear of the first direction-changing mechanism are coupled together so that the wiping base moves when the gear rack is driven by the gear.

4. The service station of claim 1, wherein an angle between the direction of movement of the print module and the direction of movement of the cap is greater than or equal to 70°.

5. The service station of claim 1, wherein the second direction-changing mechanism furthermore comprises a gear, a rod and a bumper plate, the gear is connected on the base, one end of the rod connects with the gear, the other end of the rod connects with the bumper plate, the hamper plate is located in a position on a traveling path of the print module so that a rotation of the gear caused by the rotation of the rod when the print module acts on the bumper plate drives the second moving mechanism.

6. The service station of claim 5, wherein the base furthermore comprises a groove and the second moving mechanism furthermore comprises a capping base, a sliding track and a gear rack, the capping base has a surface with the cap set up thereon, the sliding track and the gear rack are also set up on the capping base with the sliding track engaged with the groove op the base, the gear rack and the gear of the second direction-changing mechanism are coupled together so that the capping base moves when the gear rack is driven by the gear.

7. The service station of claim 1, wherein the cap is lifted toward the print head to seal the print head.

8. The service station of claim 1, wherein an angle between the direction of movement of the print module and the direction of movement of the wiper is greater than or equal to 70°.

9. A service station for a print head of a print module in a printing system, at least comprising:

a base;

a direction-changing mechanism set up on the base;

a moving mechanism set up on the base and coupled to the direction-changing mechanism; and a wiper set up on the moving mechanism, wherein the print module drives the direction-changing mechanism and, in turn, drives the moving mechanism so that the wiper is set in motion and slides across the print head to clear away dried ink from the print head via a linear moving of the moving mechanism.

10. The service station of claim 9, wherein the direction-changing mechanism furthermore comprises a gear, a rod and a bumper plate, the gear is connected to the base, one end of the rod connects with the gear, the other end of the rod connects with the bumper plate and the bumper plate is positioned on a traveling path of the print module so that a rotation of the gear caused by the rotation of the rod when the print module acts on the bumper plate drives the moving mechanism.

11. The service station of claim 10, wherein the base furthermore comprises a groove and the moving mechanism furthermore comprises a wiping base, a sliding track and a gear rack, the wiper is set up on the wiping base, the sliding track and the gear rack are also let up on the wiping base with the sliding track engaged with the groove on the base, the gear rack and the gear of the direction-changing mechanism are coupled together so that the wiping base moves when the gear rack is driven by the gear.

12. The service station of claim 9, wherein an angle between the direction of movement of the print module and the direction of movement of the wiper is greater than or equal to 70°.

13. A method of cleaning a print head of a print module in a printing system, wherein the printing system comprises a direction-changing mechanism, a moving mechanism and a wiper such that the direction-changing mechanism and the moving mechanism are coupled and the wiper is connected to the moving mechanism, the method comprising the steps of:

driving the print module to impart a rotary action to the direction-changing mechanism;

generating a linear motion to the moving mechanism by the rotary action of the direction-changing mechanism; and sliding the wiper across the print head to scrap off dried ink from the print head by the motion of wiper driven by the linear motion of the moving mechanism.

14. The method of claim 13, wherein an angle between the direction of movement of the print module and the direction of movement of the wiper is greater than or equal to 70°.

15. A method of sealing a print head of a print module in a printing system, wherein the printing system comprises a direction-changing mechanism, a moving mechanism and a cap with the direction-changing mechanism and the moving mechanism coupled together and the cap met up on the moving mechanism, the method comprising the steps of:

driving the print module to impart a rotary action to the direction-changing mechanism;

generating a linear motion to the moving mechanism by the rotary action of the direction-changing mechanism; and lifting the cap toward the print head to seal the print head by the motion of the cap driven the linear motion of the moving mechanism.

16. The service station of claim 15, wherein an angle between the direction of movement of the print module and the direction of movement of the cap is approximately 90°.

* * * * *